US010412498B2

(12) United States Patent
Hayner et al.

(10) Patent No.: US 10,412,498 B2
(45) Date of Patent: Sep. 10, 2019

(54) ACOUSTIC TRANSDUCER WITH PIVOTED SURROUND

(71) Applicant: BOSE CORPORATION, Framingham, MA (US)

(72) Inventors: Mark A. Hayner, Belmont, MA (US); Robert Preston Parker, Westborough, MA (US)

(73) Assignee: BOSE CORPORATION, Framingham, MA (US)

( * ) Notice: Subject to any disclaimer, the term of this patent is extended or adjusted under 35 U.S.C. 154(b) by 0 days.

(21) Appl. No.: 15/849,789

(22) Filed: Dec. 21, 2017

(65) Prior Publication Data

US 2019/0200138 A1 Jun. 27, 2019

(51) Int. Cl.

| | |
|---|---|
| ***H04R 7/00*** | (2006.01) |
| ***H04R 9/06*** | (2006.01) |
| ***H04R 7/12*** | (2006.01) |
| ***H04R 7/18*** | (2006.01) |

(52) U.S. Cl.

CPC ..... *H04R 9/06* (2013.01); *H04R 7/127* (2013.01); *H04R 7/18* (2013.01); *H04R 2400/11* (2013.01)

(58) Field of Classification Search

CPC ... H04R 7/26; H04R 7/16; H04R 7/18; H04R 2307/207

See application file for complete search history.

(56) References Cited

U.S. PATENT DOCUMENTS

| | | | | |
|---|---|---|---|---|
| 9,226,074 | B2 * | 12/2015 | Zhu | H04R 7/20 |
| 9,253,576 | B2 * | 2/2016 | Tripp | H04R 9/04 |
| 9,763,013 | B2 * | 9/2017 | Lucas | H04R 9/027 |
| 10,129,652 | B2 * | 11/2018 | Vieites | H04R 7/26 |
| 2011/0243365 | A1 | 10/2011 | Carlmark et al. | |
| 2015/0136517 | A1 | 5/2015 | Zhu et al. | |

FOREIGN PATENT DOCUMENTS

| | | | |
|---|---|---|---|
| EP | 0556786 | A2 | 8/1993 |
| EP | 2852180 | A1 | 3/2015 |

OTHER PUBLICATIONS

International Search Report and Written Opinion for International Application No. PCT/2018/061317 dated Jan. 31, 2019.

* cited by examiner

*Primary Examiner* — Amir H Etesam
(74) *Attorney, Agent, or Firm* — Patterson + Sheridan, LLP

(57) ABSTRACT

An apparatus includes a frame and a surround element that couples a diaphragm to the frame such that the diaphragm is movable in a reciprocating manner relative to the frame. The surround element includes a half-roll element having a concave apparent area and a convex apparent area. The concave and the convex apparent areas are disproportionate. Another apparatus includes a diaphragm, a frame, and a surround element that couples the diaphragm to the frame such that the diaphragm is movable in a reciprocating manner relative to the frame. The surround element includes a half-roll element having a horizontal span and a free-length. A ratio of the horizontal span to the free-length is constant throughout the half-roll element. According to another example, an apparatus includes a landing and a half-roll element adjacent the landing. The half-roll element includes an inner portion, an outer portion having a variable thickness, and a transition portion located between the inner portion and the outer portion.

13 Claims, 7 Drawing Sheets

ACOUSTIC TRANSDUCER WITH PIVOTED SURROUND

I. FIELD OF THE DISCLOSURE

The present disclosure relates generally to acoustic devices, and more particularly, to a surround for a radiating surface of an acoustic transducer.

II. BACKGROUND

A levered transducer can produce relatively large sound for a small, thin acoustic transducer. A lever is driven by a motor to pivot up and down within a sealed enclosure. The end of the lever is attached to a rigid diaphragm, such as an acoustically radiating cone. The levered movement of the diaphragm causes changes in air pressure, which results in the production of sound. A surround element allows the diaphragm to move in a reciprocating manner relative to a fixed frame. The movement and unequal pressure between the enclosure and the ambient surrounding can cause the surround to buckle or change its effective radiating area as function of cone position, resulting in sound distortion.

III. SUMMARY OF THE DISCLOSURE

All examples and features motioned herein can be combined in any technically possible manner.

According to a particular aspect, an apparatus includes a frame and a surround element that couples the diaphragm to the frame such that the diaphragm is movable in a reciprocating manner relative to the frame. The surround element includes a half-roll element having a concave apparent area and a convex apparent area. The concave and the convex apparent areas vary (i.e., are unequal and otherwise disproportionate) in size.

According to an example, the ratio of the concave apparent area to the convex apparent area is greater than one. In another example, the ratio of the concave apparent area to the convex apparent area is less than one. The concave apparent area of an example includes a total apparent area of a plurality of concave sections of the surround element. The convex apparent area includes a total apparent area of a plurality of convex sections of the surround element. A pivoting lever is coupled to the frame.

According to another implementation, a transition apparent area is positioned in between the concave apparent area and the convex apparent area. The transition apparent area includes a horizontal span and a free-length, wherein a ratio of the horizontal span to the free-length is approximately constant throughout the transition apparent area. The half-roll element includes an inner portion and an outer portion. At least one of a thickness and a span differs between the outer portion (e.g., farther from the pivot) and the inner portion (e.g., closer to the pivot). The outer half-roll portion has a variable thickness across a free-length of the outer half-roll portion. The inner portion has a constant thickness across a free-length of the outer half-roll portion. A span of the outer half-roll portion is thicker than a span of the inner half-roll portion. The convex apparent area includes a straight-away portion of the outer half-roll portion. The concave apparent area includes a straight-away portion of the inner half-roll portion and curved portions between the straight-away portion and the transition regions (i.e. between 1 and 2 and 1' and 2' in FIG. 3).

According to a particular example, an inner perimeter of the half-roll element is offset from an outer perimeter of the half-roll element to increase a free-length for an outer half-roll portion of the half-roll element. An effective radiating apparent area of the surround element versus an excursion of the diaphragm is nearly constant versus the excursion of the diaphragm.

According to another particular implementation, an apparatus includes a diaphragm, a frame, and a surround element that couples the diaphragm to the frame such that the diaphragm is movable in a reciprocating manner relative to the frame. The surround element includes a half-roll element having a horizontal span and a free-length. A ratio of the horizontal span to the free-length is constant throughout the half-roll element.

In an example, the half-roll element includes an inner portion and an outer portion. At least one of a thickness and a span differs between the outer portion and the inner portion.

According to another implementation, an apparatus includes a landing and a half-roll element adjacent the landing. The half-roll element includes an inner portion, an outer portion having a variable thickness, and a transition portion located between the inner portion and the outer portion.

In an example, a length of the inner portion, a length of the outer half-roll, and a length of the transition portion are set or otherwise determined in combination to produce a near constant radiating apparent area. For example, the lengths of at least two of the three may be determined based on a resultant, desired constant radiating apparent area. The inner portion includes a convex surface and the outer portion includes a concave surface.

The surround design described herein allows movement of the surround element without stretching it. Apparent areas of the surround element increase in some regions, but decrease in others such that variations cancel out each other, so that the total apparent area remains constant. This constant apparent area facilitates low distortion. The design achieves linear stiffness, as well as low distortion. These and other advantages realized by the surround system are described in the detailed description and drawings.

IV. BRIEF DESCRIPTION OF THE DRAWINGS

V. DETAILED DESCRIPTION

A surround element for an acoustic transducer produces high quality sound when driven by a levered assembly that rotates about a fixed axis. An illustrative surround element includes a stable (e.g., no buckling), near constant radiating apparent area over an entire range of diaphragm excursion. An apparent area includes a ratio of volume displaced, divided by excursion. Excursion includes how far the diaphragm travels from its resting position. The surround element has a low, nearly symmetric, nearly constant stiffness versus excursion. These features produce a low distortion sound.

According to one implementation, an inner perimeter of the surround element is offset from the outer perimeter to increase the free-length for sections of the surround element that are farther away from the pivot than those that are closer to the pivot. The straight section farthest away from the pivot is an outward directed half-roll (e.g., the convex portion), while the straight section nearest the pivot is an inward directed half-roll (e.g., the concave portion).

Transition regions may be positioned in between the nearest and furthest straight-sections. A ratio of the free-length to horizontal span is maintained at a near constant value in the transition region. The span may comprise the difference along a horizontal plane between an inner edge of the surround element half roll and an outer edge of the surround element half roll. The peripheral lengths of the inner half-roll, outer half-roll, and transition regions are varied in an implementation until a constant radiating apparent area is achieved.

A cross-sectional thickness of the outer half-roll is not constant in an example. Instead, the cross-sectional thickness is thicker in the middle of the horizontal span, as compared to the ends of the horizontal span. These dimensions facilitate enabling the pressure differential between the internal box volume and the external or ambient. The thickness in other regions of the illustrative surround element is a constant over an entire span. In another implementation, the thickness of the inner half-roll similarly varies (e.g., may be thicker in the middle of its horizontal span).

An effective radiating apparent area of the surround versus excursion is nearly constant versus excursion. As such, a nearly linear relationship of box pressure to excursion is achieved in the presence of normal box pressures. A separate implementation may be applied to passive radiators, where levered motion eliminates problems relating to rocking stability.

Figure 1:
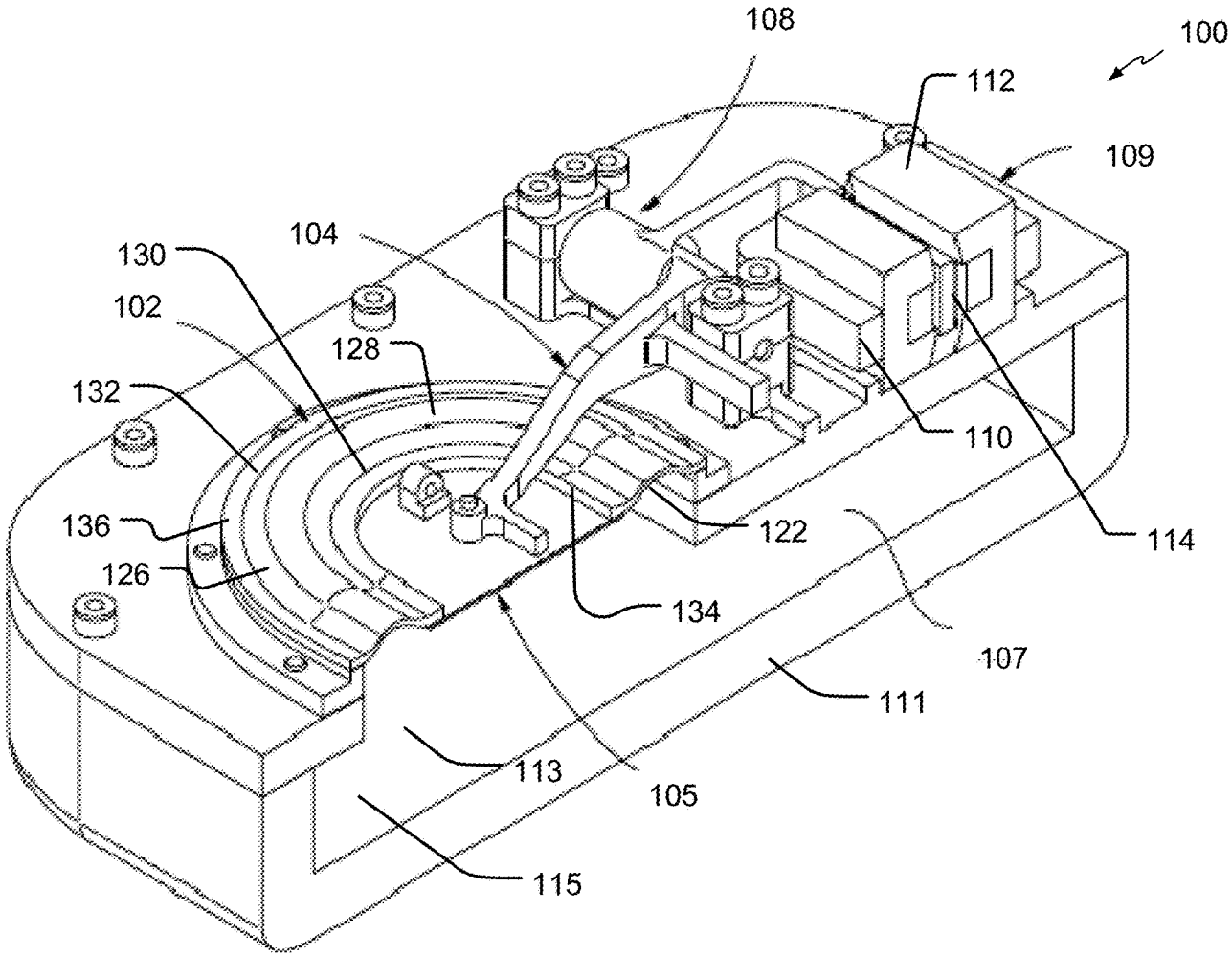
FIG. 1 is a perspective cutaway view of an illustrative acoustic transducer with levered surround motion and a surround element.

FIG. 1 illustrates a perspective view an acoustic device, such as a loudspeaker, woofer, driver, or transducer. More particularly, FIG. 1 shows an acoustic transducer 100 with levered surround motion and a surround element 102, sometimes referred to as a surround. The surround element 102 has a racetrack shape with an outward half-roll surround of constant thickness, constant span, and constant free-length around its periphery.

The acoustic device 100 includes a rigid diaphragm 105 (e.g., sometimes referred to as a cone) coupled to a stationary frame 107 via the surround element 102. The stationary frame 107 includes a baseplate 111 and a box 113 that comprise an inner box volume 115. Though illustrated as a flat cone in FIG. 1, the diaphragm of another example may be circular or non-circular in shape. For example, and without limitation, the diaphragm could be an ellipse, square, rectangle, oblong, or racetrack-shaped. The frame 107 may be coupled to the acoustic enclosure (e.g., a volume of air between the box 113 and baseplate 111). The surround element 102 allows the diaphragm 105 to move in a reciprocating manner relative to the frame 107 and enclosure in response to an excitation signal provided to a motor 109. The motor 109 outputs a force which couples to diaphragm 105. While the motor 109 is a moving magnet type motor, a moving coil motor may alternatively be used. Movement of the diaphragm 105 causes changes in air pressure, which results in the production of radiated sound.

The motor 109 drives a lever 104. The lever 104 is located proximate bushings 108 and pivots around an axis. The motor 109 includes coils 110, a core 112, and a magnet 114. The magnet 114 is secured to the lever 104 and rotates up and down. The motor 109 is not aligned with a diaphragm 116 (e.g., does not reside below the diaphragm 116). Rather, the motor 109 is off to the side of the diaphragm 105 to allow for a flatter transducer configuration. The lever 104 is connected to and drives the diaphragm 105 (i.e., the flat cone).

The diaphragm 105 is mechanically connected to the racetrack-shaped surround element 102. A side 122 of the surround element 102 nearest to the pivot of the lever 104 does not move as much as a side 126 of the surround element 102 farthest away from a pivot of the lever 104. The surround element 102 includes a racetrack-shaped half-roll element 128 having an inner edge 130 and an outer edge 132, separated by a radial width, or span. [The inner edge 130 of the half-roll element is offset from an outer edge 132 of the half-roll element to increase a free-length for an outer half-roll portion of the half-roll element of the surround element 102. In the embodiment of FIG. 1, the free-length around the perimeter is a constant.

The surround element 102 includes an inner landing 134 extending radially inward from the inner edge 130 and an outer landing 136 extending radially outward from the outer edge 132 for connection to the diaphragm 105 and the frame 107, respectively. The surround element 102 may be connected to the diaphragm 105 and the frame 107 using any suitable method, including use of an adhesive or by melting the surround element material to the diaphragm or frame, to name two examples.

Further, although the surround element 102 described herein is racetrack-shaped, the surround element of another example could also be another shape. For example, without limitation, the surround element could be an ellipse, toroid, square, rectangle, oblong, circle, or other non-racetrack geometries.

The surround element 102 may be made from any suitable material, including, but not limited to, fabric, rubber, foam, metal, or polyurethane plastic, such as thermoplastic polyurethane. In some implementations, the surround element 102 may include rib and groove features (not shown) that may enhance axial stiffness, free-length, force-deflection relationships, and buckling resistance, which may allow the static and/or dynamic mass of the suspension element 102 to be reduced.

Figure 2:
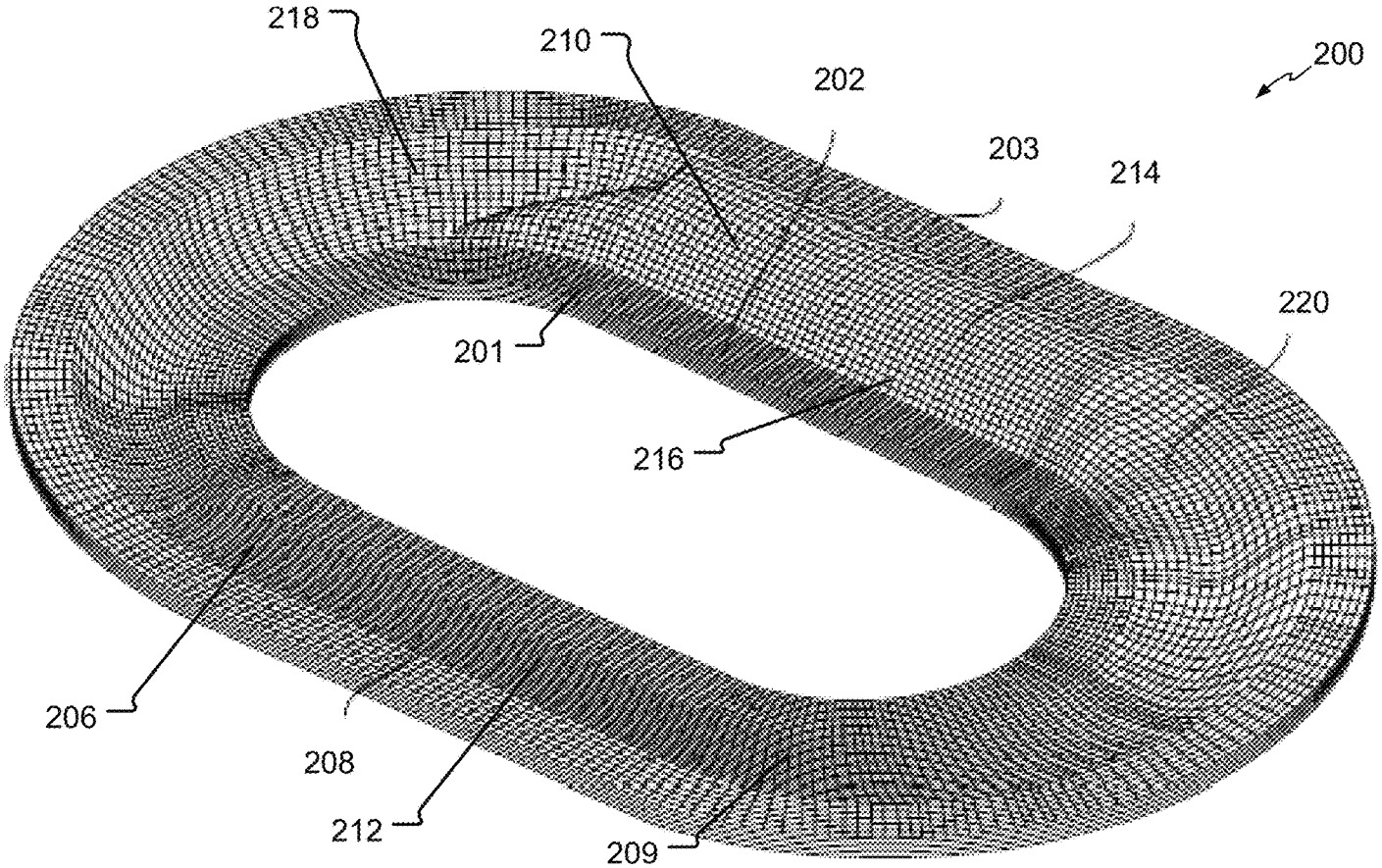
FIG. 2 is a top, perspective view of a surround element having concave, convex, and transition portions.

FIG. 2 is a top, perspective view of a surround element 200 having concave and convex portions 208, 214, respectively. The concave portion 208 may be included within an inner half-roll element 206. The convex portion 214 may be included within an outer half-roll element 210. In another example, the concave portion may be included within outer half-roll element, and the convex portion may be included within the inner half-roll element. The surround element 200 includes an interior flat portion 201 and an exterior flat portion 203. The inner half roll surround element 206 is configured to be positioned nearest a lever (not shown). The inner half-roll element 206 includes a straightaway section 212 comprising the concave portion 208 (e.g., oriented downwards when installed and looking down on the acoustic transducer) and a curved or rounded section 209.

The outer half-roll element 210 includes a straightaway section 216 comprising the convex portion 214 (e.g., oriented upwards). As shown in FIG. 2, the outer half-roll element 210 includes two transition regions 218, 220. The transition regions 218, 220 include portions that transition between the convex portion 214 to the concave portion 208. As can be seen in the perspective view of FIG. 2, the transition regions 218, 220 have varying height, free-length, and span characteristics throughout the regions 218, 220. While only two transition regions are shown, another example includes more transition regions, as well as more concave and convex sections.

The half-roll configurations allow movement of the surround element 200 with minimal stretching, which helps to maintain a low mechanical stiffness. Convex parts of the surround element 200 extend up and transition to the concave parts in such a manner that a ratio of the free-length to span is held constant (e.g. even within the transition regions). The free-length of outer half-roll is longer than the free-length of the inner half-roll. Apparent areas (e.g., acoustically radiating areas) of the surround element 200 increase in some regions in response to excursion in a particular direction, but decrease in others such that variations cancel-out each other, so that the total apparent area remains nearly constant at all cone positions. This constant apparent area facilitates low distortion. The design achieves a relatively low linear stiffness, as well as low distortion.

Figure 3:
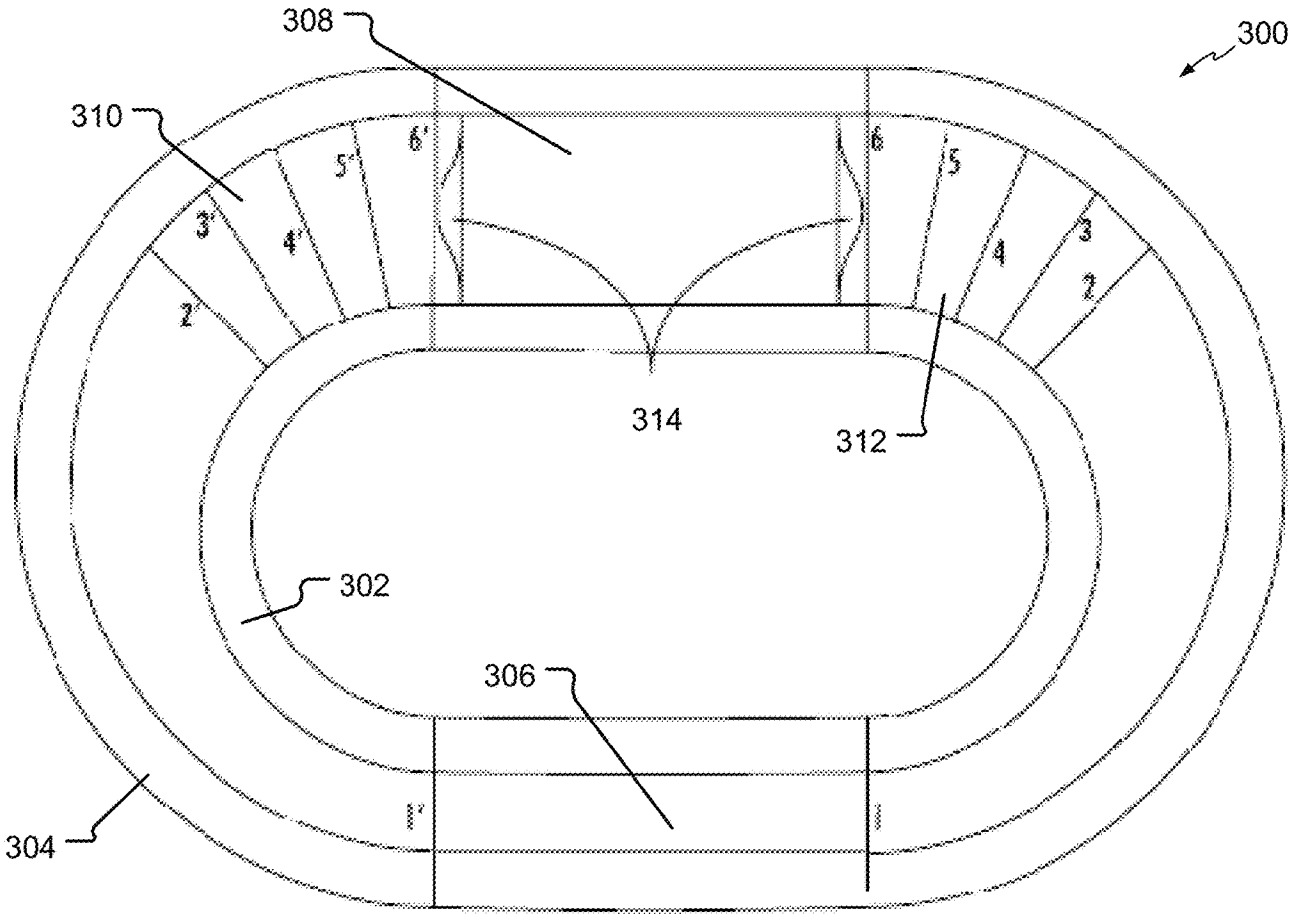
FIG. 3 illustrates a diagram of a surround element showing delineated transitions of between convex and concave portions, as well as spans.

FIG. 3 illustrates a diagram of a surround element 300 showing delineated transitions of between convex and concave portions, as well as transitions between thicknesses and spans of the surround element 300. The surround element of FIG. 3 may be similar to the surround element 200 of FIG. 2. The surround element 300 includes an interior flat landing, or platform portion 302 and an exterior flat platform portion 304. An inner half-roll 306 and an outer half-roll 308 are shown, along with transition portions 310, 312. As described above, the inner half roll 306 is configured to be positioned nearest a lever pivot (not shown). The inner half-roll 306 has a smaller span and apparent area than the outer half roll 308.

Figure 4:
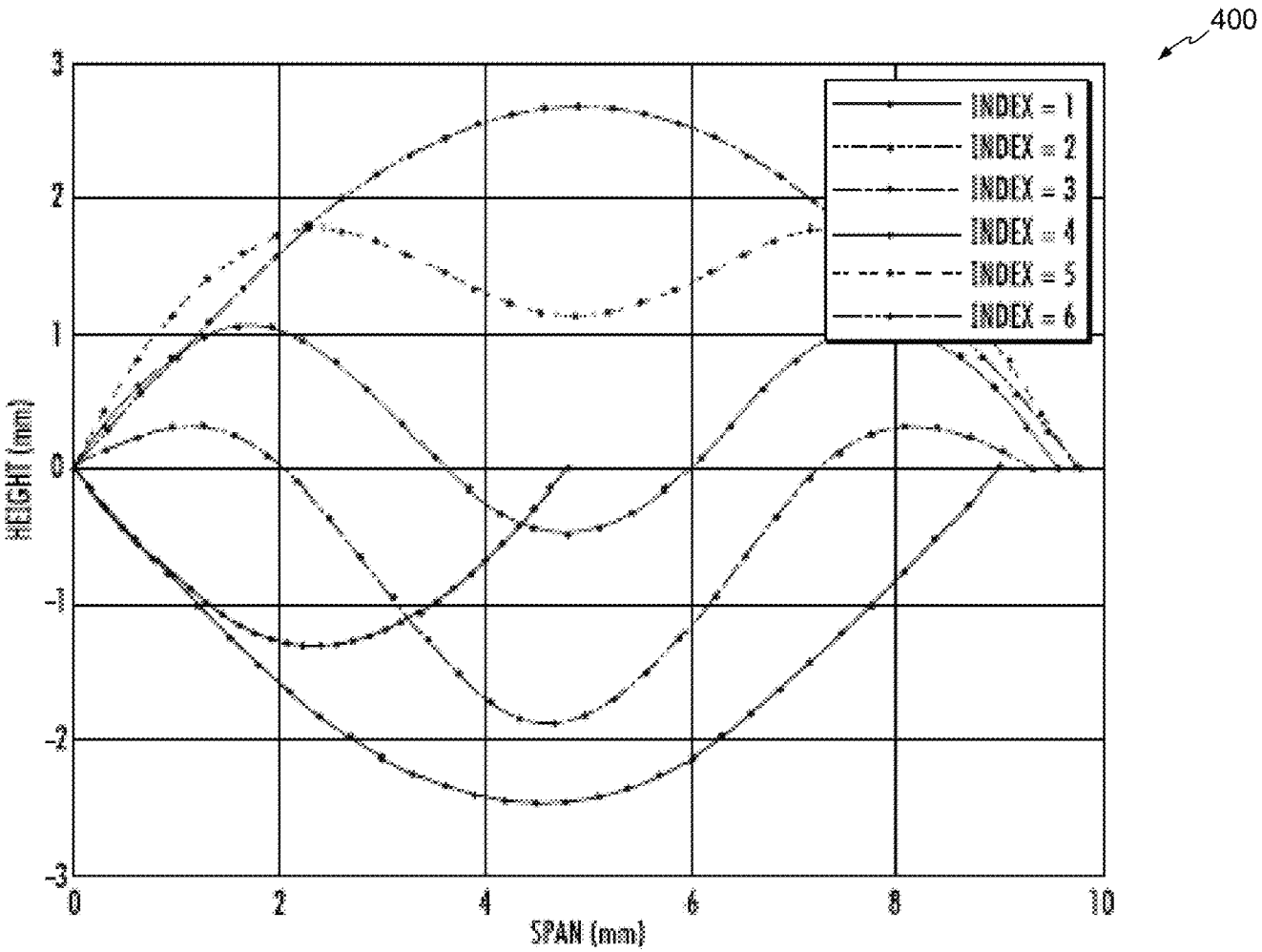
FIG. 4 shows plotted free-length profiles corresponding to sections of the transition regions of FIG. 3.

The straight inner half-roll 306 may be concave, while the outer half-roll 308 is convex. A distance along the span of the outer half-roll 308 may transition from constant thickness to variable thickness over a length 314, which may correspond to a free length of the inner straightaway portion. The transition portion 310 of FIG. 3 is delineated to illustrate different sections (i.e., 6, 5, 4, 3, 2, and 1) of the transition portion 310. The height of each section 6, 5, 4, 3, 2, and 1 of FIG. 3 is plotted against the span of each section 6, 5, 4, 3, 2, and 1 in the graph of FIG. 4. That is, surround profiles (e.g., for height versus span) are plotted in FIG. 4. The indexes of profiles in the table of FIG. 4 correspond to the sections 6, 5, 4, 3, 2, and 1 of FIG. 3. Similar to the transition portion 310, the transition portion 312 of FIG. 3 includes is shown having different sections (i.e., 6', 5', 4', 3', 2', and 1'). The regions from 1-2 and from 1'-2' may also be concave, but may not be a transition region. In contrast, the free-lengths in the straightaway concave regions increase for areas farther away from the pivot, while the free-length to span ratio is held constant.

Figure 5:
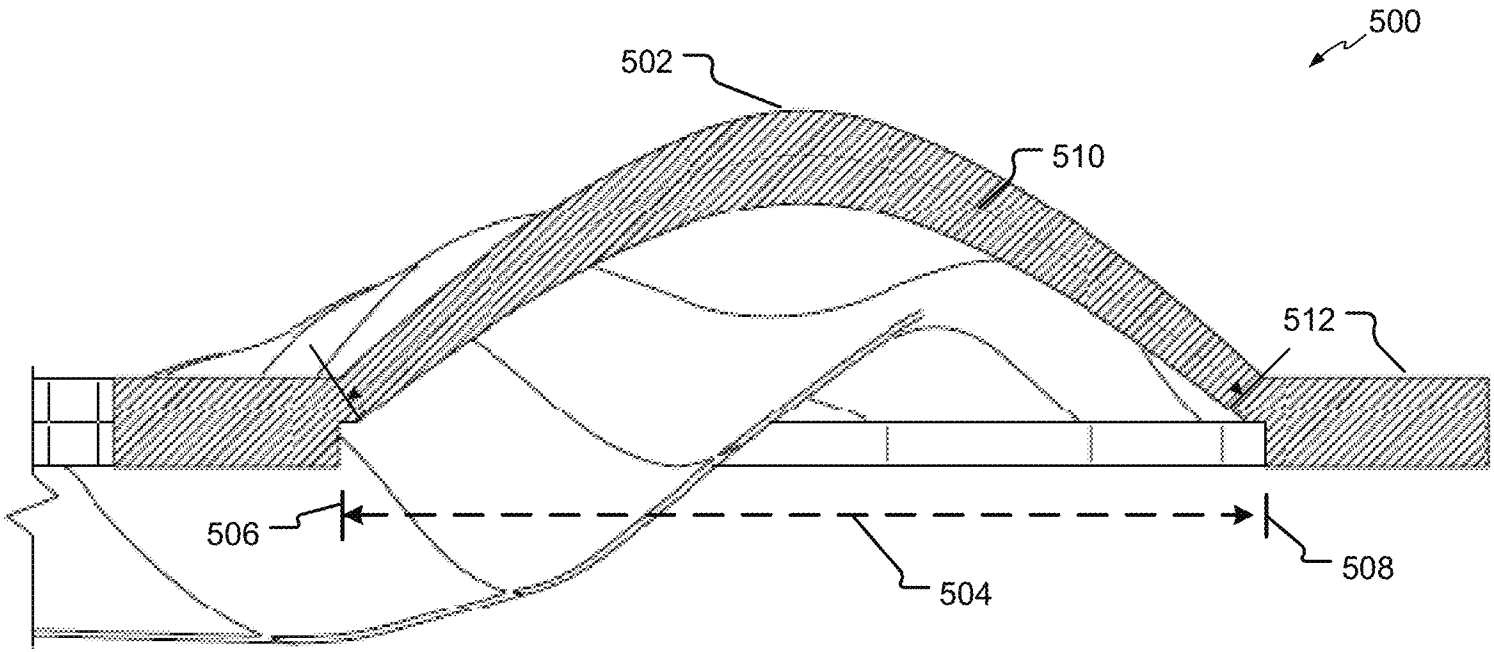
FIG. 5 is a cross-sectional view showing a variable thickness of an outer half-roll surround element.

FIG. 5 is a cross-sectional view showing a variable thickness of an outer half-roll 500. A cross-sectional thickness of the outer half-roll 500 is variable, as shown in FIG. 5. The cross-sectional thickness is thicker in the middle 502 of the horizontal span 504, as compared to the ends 506, 508 of the horizontal span 504. FIG. 5 also illustrates an example of a free-length 510, which tracks an arc of the outer half-roll 500 and spans the straight distance of the horizontal span 504. The free-length 510 of an example may gradually transition to a landing 512 to reduce stress concentrations. As described herein, the thickness of the half-roll 500 may vary throughout the outer half-roll. In contrast, the thickness throughout the transition portion and the inner half-roll may be constant. The cross-sectional area of the inner half-roll may vary (e.g., the inner half-roll may be thicker in the middle than at the edges), but alternatively the thickness and cross-sectional profile may be constant throughout the inner half-roll. The effective moving mass of the surround is nearly equal to that of a conventional surround, while the non-constant outer half-roll 500 only has additional thickness where it is needed.

Figure 6:
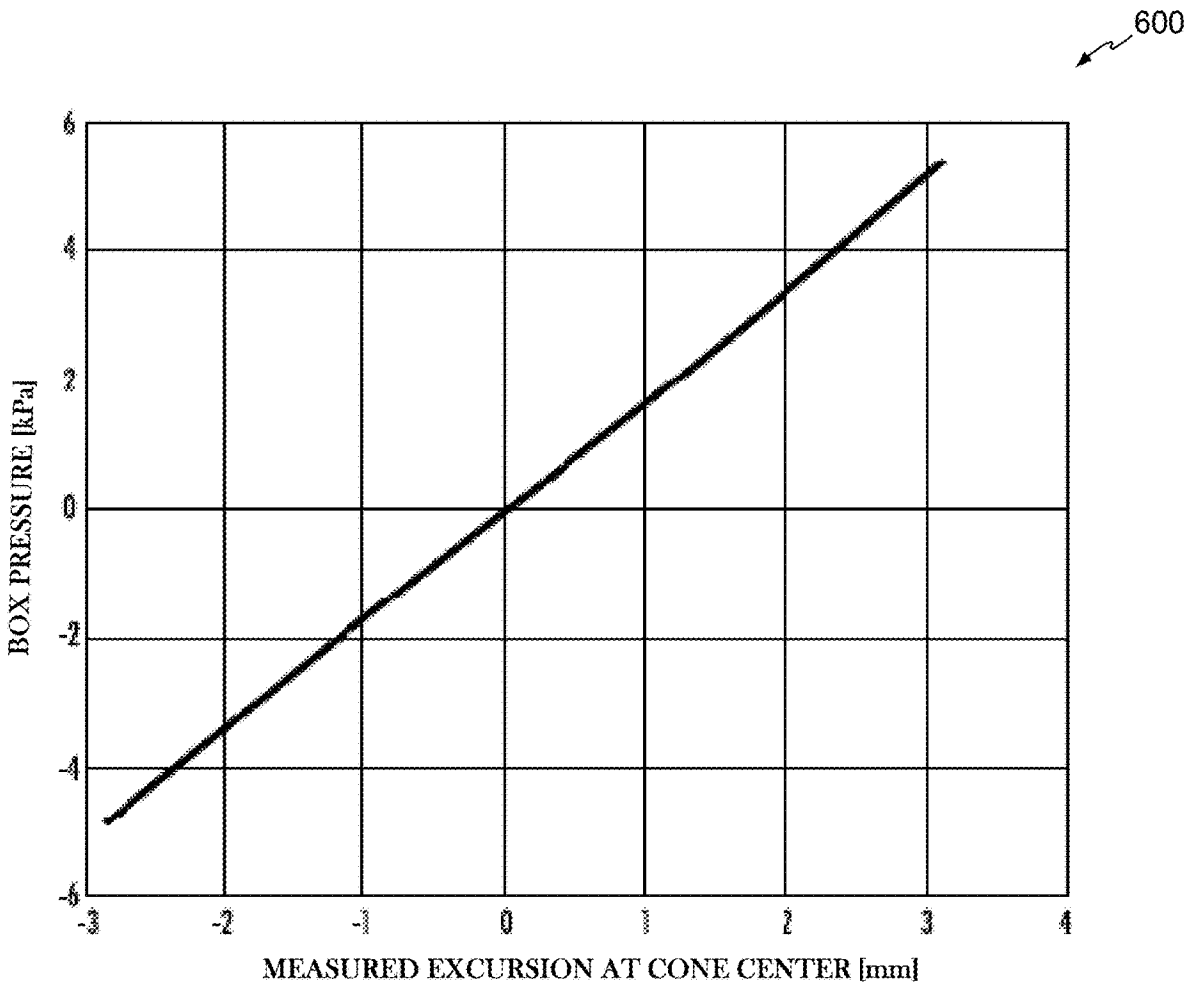
FIG. 6 is a graph that plots a sealed box internal pressure versus the excursion of the diaphragm.

FIG. 6 is a graph 600 that plots pressure within an acoustic enclosure, or box, against the excursion. As described herein, the enclosure may comprise a volume defined by the baseplate and the box. The linearity of the graph 600 indicates a near constant radiating apparent area of the surround element versus the excursion of the diaphragm is nearly constant versus the excursion of the diaphragm. The nearly linear relationship of box pressure versus excursion indicates a nearly constant radiating apparent area. This feature enables low distortion, among other benefits.

Figure 7:
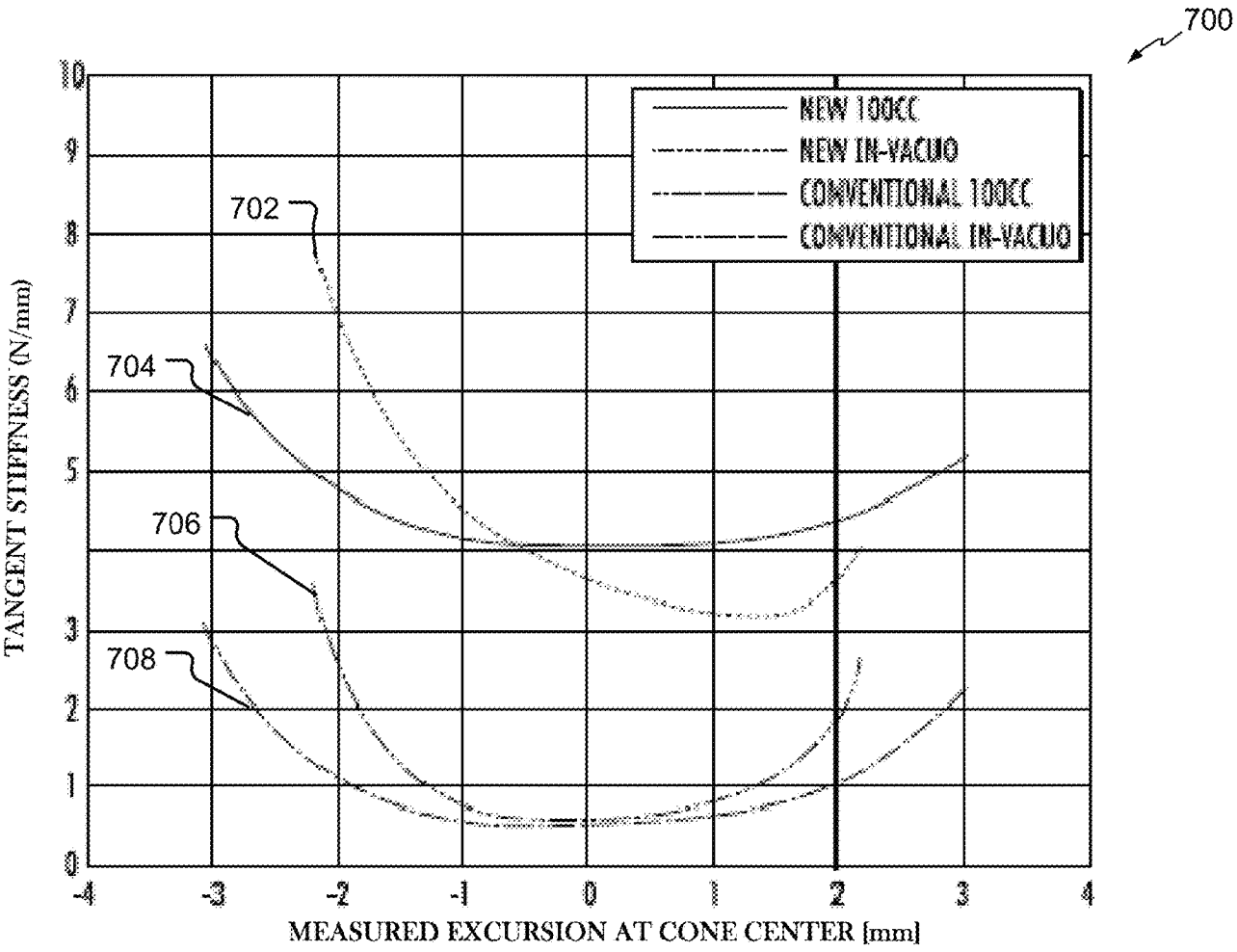
FIG. 7 is a graph showing plots of tangent stiffness versus excursion in an illustrative acoustic transducer having a surround element as described herein.

FIG. 7 is a graph 700 showing plots 702, 704, 706, 710 of a computer simulation of the tangent stiffness over excursion. The plot 702 corresponds to simulation using 100 cubic centimeter (cc) acoustic volume using a conventional surround, and 704 shows the plotted results using the surround described herein. Plot 706 shows results using a conventional surround in a vacuum environment, overlain by plot 708, which shows results using the surround described herein. The results show that the stiffness of the surround is more symmetric, as compared to a conventional surround design. This symmetry enables lower distortion and higher excursion for more acoustic output.

Apparent area is useful to describe how a section of a surround or cone may contribute to the sound pressure radiated by the transducer. The total apparent area of all areas of the surround and all areas of the cone is usually defined by the variable Sd. To minimize distortion, it is desirable to have an Sd that is nearly a constant versus position of the lever.

Convex surround surfaces tend to have less apparent area per unit rotation of the lever arm as the cone moves outward (increasing the box volume) and, thus, contribute less to the sound pressure radiated by the transducer. In other words, for a given area of convex section of the surround, its apparent area is less when the cone is near its extreme outward position than when the cone is near its center position. Conversely, concave surfaces tend to have more apparent area as the cone moves outward. As the cone moves inward (decreasing the box volume), these tendencies are reversed. The convex surfaces tend to have more apparent area and the concave surfaces tend to have less apparent area at the extreme inward position than the near center position.

In addition to the concavity of the surround, the position of a surround surface relative to the pivot point also affects the apparent area. Surround surfaces farther away from the pivot move farther per unit rotation of the lever arm than those that are closer to the pivot. The surround surfaces farther away from the pivot, therefore, contribute more to the sound pressure radiated by the transducer than those closer to the pivot and, thereby, have a larger apparent area due to their location. This is true not only for surround but also for the cone.

The surround designs discussed herein find a balance between the area and location from the pivot of both the convex and concave surfaces, such that, the radiated sound for any incremental rotation of the lever due to both the surround and the cone is the same regardless of the lever position (near center, extreme inward, extreme outward, and positions in between). In other words, the total apparent area of the surround (i.e., the sum of the apparent areas from all regions of the surround) and the cone is constant for all lever positions (e.g., angles).

One consequence that follows is that, in general, both the total actual (e.g., geometric) area and the total apparent area of the convex surround regions are not equal to each other or that of the concave surround regions. Depending on the design, the actual area of the convex region might be more or might be less than the concave region. Also, depending on the design, the apparent area of the convex region might be more or might be less than the concave region. AU such designs are contemplated by examples discussed herein.

The previous description of the disclosure is provided to enable any person skilled in the art to make or use the disclosure. Various modifications to the disclosure will be readily apparent to those skilled in the art, and the generic principles defined herein may be applied to other variations without departing from the spirit or scope of the disclosure. Thus, the disclosure is not intended to be limited to the examples and designs described herein, but is to be accorded the widest scope consistent with the principles and novel features disclosed herein.

The invention claimed is:

1. An apparatus comprising:

a diaphragm;

a frame; and a surround element that couples the diaphragm to the frame such that the diaphragm is movable in a reciprocating manner relative to the frame, the surround element comprising:

an inner half-roll element comprising a straightaway concave section with curved concave sections at each end of the straightaway concave section; and an outer half-roll element comprising a straightaway convex section and a transition region at each end of the convex section to transition to a corresponding end of the inner half-roll element, wherein at least one concave apparent area associated with inner half-roll element is different from at least one convex apparent area associated with the outer half-roll element.

2. The apparatus of claim 1, wherein a ratio of the at least one concave apparent area to the at least one convex apparent area is greater than one.

3. The apparatus of claim 1, wherein a ratio of the at least one concave apparent area to the at least one convex apparent area is less than one.

4. The apparatus of claim 1, further comprising a rotating lever coupled to the frame.

5. The apparatus of claim 1, wherein a transition apparent area of the transition region includes a horizontal span and a free-length, wherein a ratio of the horizontal span to the free-length is approximately constant throughout the transition apparent area.

6. The apparatus of claim 1, wherein the outer half-roll element has a variable thickness across a free-length of the outer half-roll element, and wherein a thickness is greater towards a middle portion of the free-length.

7. The apparatus of claim 1, wherein the inner half-roll element has a constant thickness across a free-length of the inner half-roll element.

8. The apparatus of claim 1, wherein a span of the outer half-roll element is thicker than a span of the inner half-roll element.

9. The apparatus of claim 1, wherein a center of an inner perimeter of the surround element is offset from a center of an outer perimeter of the surround element to increase a free-length for the outer half-roll element of the half-roll element.

10. The apparatus of claim 1, wherein an effective radiating apparent area of the surround element versus an excursion of the diaphragm is nearly constant versus the excursion of the diaphragm.

11. An apparatus comprising:

a diaphragm;

a frame; and a surround element that couples the diaphragm to the frame such that the diaphragm is movable in a reciprocating manner relative to the frame, the surround element comprising:

an inner half-roll element comprising a straightaway concave section with curved concave sections at each end of the straightaway concave section; and an outer half-roll element comprising a straightaway convex section and a transition region at each end of the convex section to transition to a corresponding end of the inner half-roll element, wherein at least one concave apparent area associated with inner half-roll element is different from at least one convex apparent area associated with the outer half-roll element wherein a transition apparent area of the transition region includes a horizontal span and a free-length, wherein a ratio of the horizontal span to the free-length is constant throughout the transition apparent area.

12. The apparatus of claim 11, wherein at least one of a thickness and a span differs between the outer half-roll element and the inner half-roll element.

13. The apparatus of claim 1, wherein the surround element is axially asymmetric across at least one axis.

* * * * *